US012460496B2

(12) United States Patent
Smith et al.

(10) Patent No.: US 12,460,496 B2
(45) Date of Patent: Nov. 4, 2025

(54) PRESSURE TRANSFER SLEEVE FOR TOP SLIP RETENTION

(71) Applicant: Halliburton Energy Services, Inc., Houston, TX (US)

(72) Inventors: Donald Ray Smith, Duncan, OK (US); Matthew Todd Howell, Houston, TX (US); Kyle Wayne Davis, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/787,748

(22) Filed: Jul. 29, 2024

(65) Prior Publication Data

US 2025/0122772 A1 Apr. 17, 2025

Related U.S. Application Data

(60) Provisional application No. 63/590,987, filed on Oct. 17, 2023.

(51) Int. Cl.
*E21B 23/06* (2006.01)
*E21B 33/128* (2006.01)

(52) U.S. Cl.
CPC ..... *E21B 23/06* (2013.01); *E21B 33/128* (2013.01)

(58) Field of Classification Search
CPC ..... E21B 33/129; E21B 23/01; E21B 23/06; E21B 29/002; E21B 33/124; E21B 33/128; E21B 33/13; E21B 34/06
See application file for complete search history.

(56) References Cited

U.S. PATENT DOCUMENTS

| | | | | |
|---|---|---|---|---|
| 5,224,540 | A * | 7/1993 | Streich | E21B 33/1293 166/134 |
| 8,668,012 | B2 | 3/2014 | Porter et al. | |
| 8,668,016 | B2 | 3/2014 | Porter et al. | |
| 8,695,695 | B2 | 4/2014 | Moeller et al. | |
| 8,695,710 | B2 | 4/2014 | Howell | |
| 8,807,210 | B2 | 8/2014 | Smith et al. | |
| 8,875,799 | B2 | 11/2014 | Smith et al. | |
| 9,260,940 | B2 | 2/2016 | Howell et al. | |
| 9,273,549 | B2 | 3/2016 | Walton et al. | |
| 9,279,310 | B2 | 3/2016 | Howell et al. | |
| 9,334,710 | B2 | 5/2016 | Pacey et al. | |
| 9,366,134 | B2 | 6/2016 | Walton et al. | |

(Continued)

OTHER PUBLICATIONS

International Search Report and Written Opinion for International Patent Application No. PCT/US2024/043071 dated Dec. 2, 2024. PDF file. 10 pages.

*Primary Examiner* — Daniel P Stephenson
(74) *Attorney, Agent, or Firm* — Scott Richardson; C. Tumey Law Group, PLLC

(57) ABSTRACT

Disclosed herein are various embodiments of an isolation device comprising a top slip, a top slip prop in engagement with the top slip, a bottom slip, a bottom slip prop in engagement with the bottom slip, a packer element positioned between the top slip prop and the bottom slip prop, wherein movement of the top slip prop and the bottom slip prop towards each other causes the packer element to expand outwardly, an annular receptacle formed between the inner mandrel and the top slip prop, and a pressure transfer sleeve at least partially disposed within the annular receptacle.

18 Claims, 9 Drawing Sheets

(56) References Cited

U.S. PATENT DOCUMENTS

| | | | | |
|---|---|---|---|---|
| 9,428,976 | B2 | 8/2016 | Porter et al. | |
| 9,458,697 | B2 | 10/2016 | Howell | |
| 9,562,429 | B2 | 2/2017 | Walton et al. | |
| 9,587,487 | B2 | 3/2017 | Walton et al. | |
| 9,726,009 | B2 | 8/2017 | Walton et al. | |
| 9,835,004 | B2 | 12/2017 | Keerthivasan et al. | |
| 9,982,530 | B2 | 5/2018 | Walton et al. | |
| 10,364,637 | B2 | 7/2019 | Walton et al. | |
| 10,392,910 | B2 | 8/2019 | Walton et al. | |
| 10,683,734 | B2 | 6/2020 | Merron et al. | |
| 11,377,923 | B2 | 7/2022 | Smith | |
| 11,629,566 | B2 | 4/2023 | Fripp et al. | |
| 11,859,458 | B2 | 1/2024 | Porter et al. | |
| 12,188,314 | B1 * | 1/2025 | Blott | E21B 33/129 |
| 2003/0226659 | A1 * | 12/2003 | Smith | E21B 33/1204 166/134 |
| 2011/0253383 | A1 | 10/2011 | Porter et al. | |
| 2012/0205120 | A1 | 8/2012 | Howell | |
| 2012/0205121 | A1 | 8/2012 | Porter et al. | |
| 2013/0008673 | A1 | 1/2013 | Smith et al. | |
| 2013/0048290 | A1 | 2/2013 | Howell et al. | |
| 2014/0158370 | A1 | 6/2014 | Porter et al. | |
| 2014/0166290 | A1 | 6/2014 | Howell | |
| 2014/0196892 | A1 | 7/2014 | Pacey et al. | |
| 2014/0202689 | A1 | 7/2014 | Walton et al. | |
| 2014/0202706 | A1 | 7/2014 | Howell et al. | |
| 2014/0202707 | A1 | 7/2014 | Howell et al. | |
| 2014/0224507 | A1 | 8/2014 | Fripp et al. | |
| 2015/0063919 | A1 | 3/2015 | Greening et al. | |
| 2016/0040492 | A1 | 2/2016 | Vinson et al. | |
| 2016/0168942 | A1 | 6/2016 | Broome et al. | |
| 2016/0251923 | A1 | 9/2016 | Keerthivasan et al. | |
| 2016/0258259 | A1 | 9/2016 | Walton et al. | |
| 2016/0258260 | A1 | 9/2016 | Walton et al. | |
| 2017/0260825 | A1 | 9/2017 | Schmidt et al. | |
| 2018/0023359 | A1 * | 1/2018 | Xu | E21B 33/12 166/376 |
| 2018/0328136 | A1 * | 11/2018 | Smith | E21B 33/129 |
| 2020/0277831 | A1 | 9/2020 | Kellner et al. | |
| 2021/0293112 | A1 | 9/2021 | Smith | |
| 2021/0324694 | A1 | 10/2021 | Fripp et al. | |
| 2022/0090458 | A1 | 3/2022 | Porter et al. | |
| 2024/0117702 | A1 * | 4/2024 | Moeller | E21B 33/128 |
| 2024/0133263 | A1 * | 4/2024 | Roberts | E21B 33/1295 |
| 2025/0122772 | A1 * | 4/2025 | Smith | E21B 33/128 |

* cited by examiner

PRESSURE TRANSFER SLEEVE FOR TOP SLIP RETENTION

CROSS-REFERENCE TO RELATED APPLICATION

The present application claims priority to U.S. Provisional Application No. 63/590,987, filed Oct. 17, 2023, the entire disclosure of which is incorporate herein by reference.

BACKGROUND

Hydraulic fracturing plugs, or "frac plugs," are used in the oil and gas industry during hydraulic fracturing operations. These plugs are designed to provide temporary zonal isolation to specific sections of a wellbore which aids in fracturing target regions of reservoir rock, thereby increasing production in these regions. This may be achieved by deploying the plugs to a target depth and engaging the sides of a casing with slips. Once fracturing is complete, these frac plugs are typically removed to enable the flow of production fluids.

It is not uncommon for frac plugs to become dislodged from their set position at the wrong time. Unset frac plugs which are unset at the wrong time may fail to be tagged during drill-out following the hydraulic fracturing.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
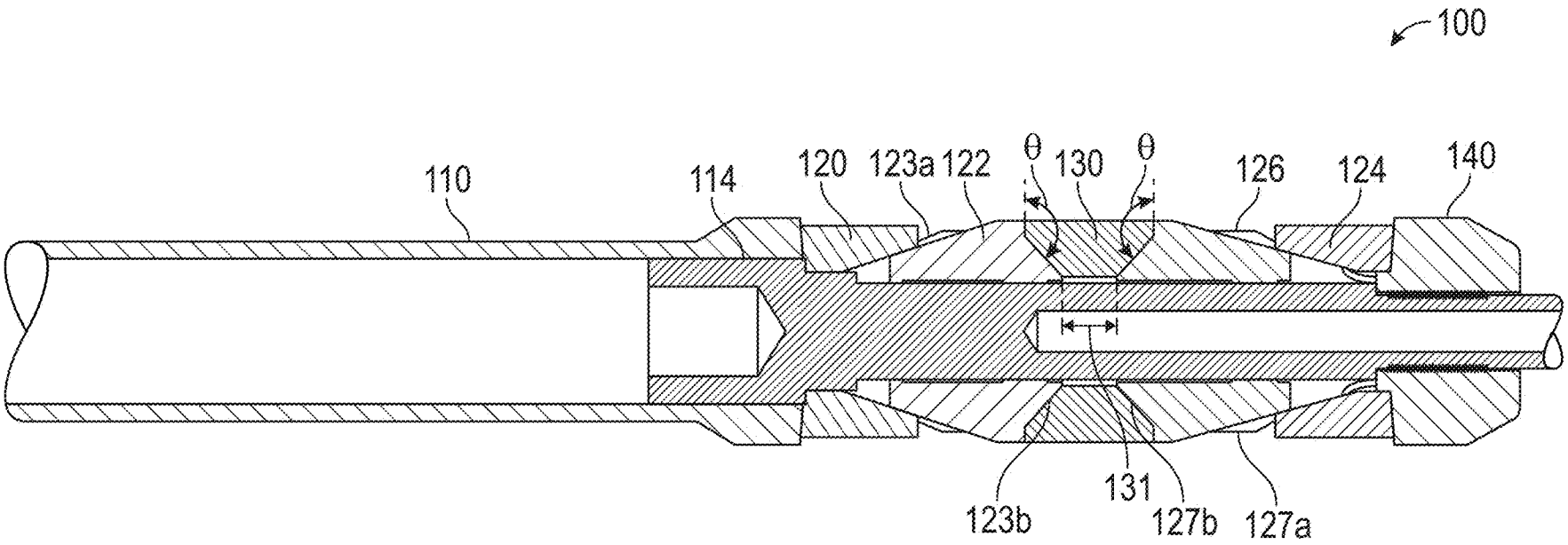
FIG. 1 illustrates a cross-sectional view of an isolation device in a run-in-hole position, in accordance with some embodiments of the present disclosure.

Disclosed herein is an isolation device and methods of using the isolation device. Particularly, the isolation device includes an inner mandrel that is removed from the isolation device after setting. The isolation device does not require a spacer ring to aid in the setting process as a setting sleeve has direct contact with the top slips. The isolation device also has a pressure transfer sleeve with a flanged end disposed around the inner mandrel.

As alluded to previously, frac plugs may become dislodged at an inappropriate time previously, during, or after a hydraulic fracturing operation. Specifically, with frac plug designs which include mandrels that only partially extend through the frac plug assembly, the slips may become dislodged or lose grip with the casing during, for example, pumping of a frac ball to land on a frac plug seat, upon landing of a frac ball, or in the period of time following a hydraulic fracturing operation. This may create uncertainty as to whether or not the frac plug performed its function effectively during the hydraulic fracturing.

The pressure transfer sleeve of the present disclosure may improve the reliability of frac plugs by lowering the risk of the frac plug becoming dislodged, thereby mitigating this uncertainty. Specifically, the pressure transfer sleeve may push on the back of top slips during frac ball pump-down and during hydraulic fracturing to ensure the top slip remains fully engaged with the casing.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular section, such as a tubing string, or within an annulus. The blockage of fluid flow prevents the fluid from flowing across the isolation device in any direction and isolates the zone of interest. In this manner, treatment techniques, such as fracturing operations, can be performed within the zone of interest.

Common isolation devices include, but are not limited to, a ball and a seat, a bridge plug, a packer, a plug, a frac plug, and a wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished by dropping or flowing a ball from the wellhead onto a seat that is located within the wellbore. The ball engages with the seat, and the seal created by this engagement prevents fluid communication into other wellbore intervals downstream of the ball and seat. As used herein, the relative term "downstream" means at a location further away from a wellhead.

Plugs, for example, frac plugs, are generally composed primarily of slips, wedges, an inner plug mandrel, a spacer ring, a mule shoe, and a rubber sealing element. The plug can also include a setting device and an additional mandrel, such as a tension mandrel or setting mandrel. The plug can be introduced into the wellbore and positioned at a desired location within a tubing string. The "tubing string" can also be a casing. The plug can be set after being placed at the desired location. As used herein, the term "set" and all grammatical variations means one or more components of the plug are actuated to keep the plug at the desired location and substantially diminish or restrict fluid flow past the outside of the plug. For example, the spacer ring can be mechanically actuated to move a top slip into engagement with the inner diameter (I.D.) of the tubing string. A mule shoe, which is typically pinned and/or threaded to the inner plug mandrel, can also be mechanically actuated to move a bottom slip into engagement with the I.D. of the tubing string. Movement of the top and bottom slips can cause top and bottom wedges to mechanically actuate the rubber sealing element to expand and engage with the I.D. of the tubing string. The rubber sealing element also expands inwardly and engages with the outer diameter of the inner plug mandrel. This expansion of the rubber sealing element creates zonal isolation by substantially diminishing or restricting fluid flow around the outside of the plug. A ball can then be seated onto the plug whereby after being seated, the ball restricts fluid flow through the inner plug mandrel.

One significant disadvantage to traditional plugs is that the inner mandrel cannot be removed after setting because the inner mandrel functions to not only support the slip wedges, but also supports the rubber sealing element via direct engagement with the sealing element. The diameter of the fluid flow path through the plug can be smaller than desired because of the presence of the inner mandrel.

Isolation devices can be classified as permanent, retrievable, or drillable. While permanent isolation devices are generally designed to remain in the wellbore after use, retrievable devices are capable of being removed after use, and drillable devices are drilled or milled after use. Removal of an isolation device from the wellbore can be accomplished by milling at least a portion of the device or the entire device. Another disadvantage to traditional plugs is an increased cost and time required to mill the plug's components. Moreover, few if any of the components can be reused after milling. As such, there is a need and ongoing industry concern for improved isolation devices.

Novel plugs are disclosed. The plug can include a packer element that is actuated to engage with an I.D. of a tubing string to set the plug. Top and bottom slip props of the plug can be self-supporting and can be shaped such that the packer element is inhibited or prevented from engaging with an inner mandrel. Thus, the slip props do not require the inner mandrel for support and the inner mandrel can be removed from the plug after setting and can be reused in other downhole tools. One of the many advantages of the novel plug is that the inner diameter of the plug is enlarged due to removal of the inner mandrel. The enlarged inner diameter creates a larger fluid flow path through the plug, which allows a greater volume of fluid to flow through the plug. Moreover, if the plug needs to be milled in order to restore fluid communication into another zone, then fewer parts require milling; thus saving time and money. The plug can be used for zonal isolation to treat a zone of interest within a subterranean formation. The treatment can be a fracturing operation. The fracturing operation can include introducing a fracturing fluid into the zone to be treated, wherein the fracturing fluid creates or enhances one or more fractures in the subterranean formation.

A zonal isolation device can include: a top slip; a top slip prop in engagement with the top slip; a bottom slip; a bottom slip prop in engagement with the bottom slip; a packer element positioned between the top slip prop and bottom slip prop, wherein movement of the top slip prop and the bottom slip prop towards each other causes the packer element to expand into engagement with an inner diameter of a tubing string; and an inner mandrel, wherein the inner mandrel is removable from the zonal isolation device after engagement of the packer element with the inner diameter of the tubing string. The zonal isolation device can include a pressure transfer device. A pressure transfer sleeve may stay in contact with the top slips after setting of the zonal isolation device. During ball pump-down and the fracturing operation, the pressure transfer sleeve may push on the back of the top slips to ensure the top slip remains fully engaged with the casing, thus preventing the zonal isolation device from becoming unset. The pressure transfer sleeve may ride on the inner mandrel and be at least partially disposed within an annular receptable formed between the inner mandrel and the top slip prop. The pressure transfer sleeve may have a flanged end that extends radially outward to engage the top slit.

Methods of isolating a zone of a subterranean formation can include: setting an isolation device within a tubing string at a desired location comprising: mechanically actuating a top slip and a bottom slip into engagement with an inner diameter of the tubing string; and causing movement of a top slip prop and a bottom slip prop towards each other, wherein the movement causes a packer element located between the top slip prop and bottom slip prop to become engaged with the inner diameter of the tubing string; and removing an inner mandrel of the isolation device after setting the isolation device within the tubing string at the desired location.

It is to be understood that the discussion of any of the embodiments regarding the plug is intended to apply to all of the method and apparatus embodiments without the need to repeat the various embodiments throughout. Any reference to the unit "gallons" means U.S. gallons.

Embodiments herein provide an isolation device comprising a top slip, a top slip prop in engagement with the top slip, a bottom slip, a bottom slip prop in engagement with the bottom slip, a packer element positioned between the top slip prop and the bottom slip prop, wherein movement of the top slip prop and the bottom slip prop towards each other causes the packer element to expand outwardly, an annular receptacle formed between the inner mandrel and the top slip prop, and a pressure transfer sleeve at least partially disposed within the annular receptacle.

The isolation device may further comprise a flanged end on the pressure transfer sleeve that extends radially outwards. The isolation device wherein the packer expands until engagement with an inner diameter of a tubing string. The isolation device further comprising a ball seat positioned on the top slip prop. The isolation device further comprising a ball seat formed in the flanged end of the pressure transfer sleeve and a ball sized to be seatable on the ball seat. The isolation device wherein the flanged end of the pressure transfer sleeve engages the top slip. The isolation device further comprising a first ratchet portion positioned on an outer surface of the pressure transfer sleeve, and a second ratchet portion positioned on an inner surface of the top slip prop which is sized to accept and engage with the first ratchet portion.

Embodiments herein provide an isolation device comprising a top slip, a top slip prop in engagement with the top slip, a bottom slip, a bottom slip prop in engagement with the bottom slip, a packer element positioned between the top slip prop and the bottom slip prop, wherein movement of the top slip prop and the bottom slip prop towards each other causes the packer element to expand outwardly, and a pressure transfer sleeve at least partially disposed within the top slip prop.

The isolation device further comprising a first ratchet portion positioned on an outer surface of the pressure transfer sleeve, and a second ratchet portion positioned on an inner surface of the top slip prop which is sized to accept and engage with the first ratchet portion. The isolation device wherein the first ratchet portion comprises a series of ridges that extend outwardly and radially from the pressure transfer sleeve, and the second ratchet portion comprises a series of ridges that extend inwardly and radially from the top slip prop.

The isolation device wherein the first and second ratchet portions engage to keep the pressure transfer sleeve from moving once disposed within the top slip prop. The isolation device wherein the first and second ratchet portions engage to keep the pressure transfer sleeve in contact with the top slip. The isolation device further comprising a ball seat formed in the top slip prop, and a ball sized to be seatable on the ball seat. The isolation device further comprising a flanged end on the pressure transfer sleeve that extends radially outwards. The isolation device further comprising a ball seat formed in the flanged end of the pressure transfer sleeve, and a ball sized to be seatable on the ball seat.

Embodiments herein also provide a method for setting an isolation device within a tubing string: running the isolation device downhole to the desired position, inserting a pressure transfer sleeve into the isolation device, said pressure transfer sleeve having a body with a flanged end at one end of the body and a ball seat positioned on the flanged end, expanding the packer until the packer engages with an inner diameter of a tubing string, and placing a ball within the ball seat.

The method wherein the step of inserting the pressure transfer sleeve is performed by inserting the body of the pressure transfer sleeve into an annular receptable. The method wherein the step of inserting the pressure transfer sleeve is performed by inserting the body of the pressure transfer sleeve into a top slip prop. The method further comprising engaging a first ratchet portion on the body of the pressure transfer sleeve with a second ratchet portion on the top slip prop. The method further comprising holding the pressure transfer sleeve within the isolation device by engaging a first ratchet portion with a second ratchet portion.

FIG. 1 shows an isolation device 100 in a run-in position according to any of the embodiments. As used herein, the terms "run into" and "run in" mean the isolation device plug is capable of being moved within a tubing string to a desired location and/or the time during which the isolation device is being introduced into a wellbore at a desired location. The isolation device 100 can be a plug. The plug can be used in an oil and gas operation. The oil or gas operation can be a fracturing operation or for zonal isolation. The isolation device 100 can be a frac plug, bridge plug, or zonal isolation plug. There can also be more than one isolation device 100 that is run into a tubing or casing string to provide zonal isolation.

As shown in FIG. 1, the isolation device 100 may include top slips 120, a top slip prop 122, a packer element 130, a bottom slip prop 126, bottom slips 124, an inner mandrel 114, and a mule shoe 140. The components of the plug may be made from a variety of materials including, but not limited to, metals, metal alloys, dissolvable materials, molded hardened polymers, resins, or resin/glass composites. Examples of metals or metal alloys that may be used include, but are not limited to, cast iron and aluminum. The packer element 130 may comprise one or more elastomeric materials including, but not limited to, natural rubbers, styrene-butadiene block copolymers, polyisoprene, polybutadiene, ethylene propylene rubber, ethylene propylene diene rubber, silicone elastomers, fluoroelastomers, polyurethane elastomers, nitrile rubbers, and dissolvable, elastomeric materials. The components of the isolation device can have a variety of dimensions that are selected for the particular wellbore operation in which the isolation device is used.

The isolation device 100 may include a slip system located on the outside of the inner mandrel 114. As shown in the Figures, the inner mandrel 114 may extend from an area below the mule shoe 140, through an inner diameter of the device, and to an area above the top slips 120. The slip system includes the top slips 120 and the bottom slips 124. The slips 120/124 can be made from a single cylinder of material, a set of slips retained in a groove on the slip prop, or a single cylinder of material containing a plurality of slots or grooves. The slips 120/124 can be located around a portion of the outside of the inner mandrel 114 and radially biased towards the outside of the inner mandrel 114. The slips 120/124 can have buttons or teeth on its face. As used herein, the terms "button" and "teeth" include one or more elements that are capable of grippingly engaging an inner diameter (I.D.) 161 of a tubing string or casing 160 to retain the isolation device 100 in a set position. The buttons or teeth can include sharp ridges machined onto the face of the slips 120/124 or sharp elements, for example, rounded or other geometric shapes that are attached to the face of the slips 120/124. The slip system can further include slip props.

As shown in FIG. 1, an upper and a lower end of each of the slips 120/124 can be formed having a conical or ramped surface. The surfaces of the slips 120/124 allow a parallel, angled surface 123*a* of a top slip prop 122 and a parallel, angled surface 127*a* of a bottom slip prop 126 to slidingly engage with the ramped surfaces of the slips 120/124. In one position, the slips 120/124 can be positioned substantially adjacent to the inner mandrel 114 and axially separated from the top slip prop 122 and bottom slip prop 126 so that the outer diameter (O.D.) of the slips 120/124 is less than or equal to the O.D. of the slip props 122/126. As used herein, the term "slip prop" includes a wedge, cone, or any device that can support the slips 120/124 when the isolation device 100 is set.

Figure 2:
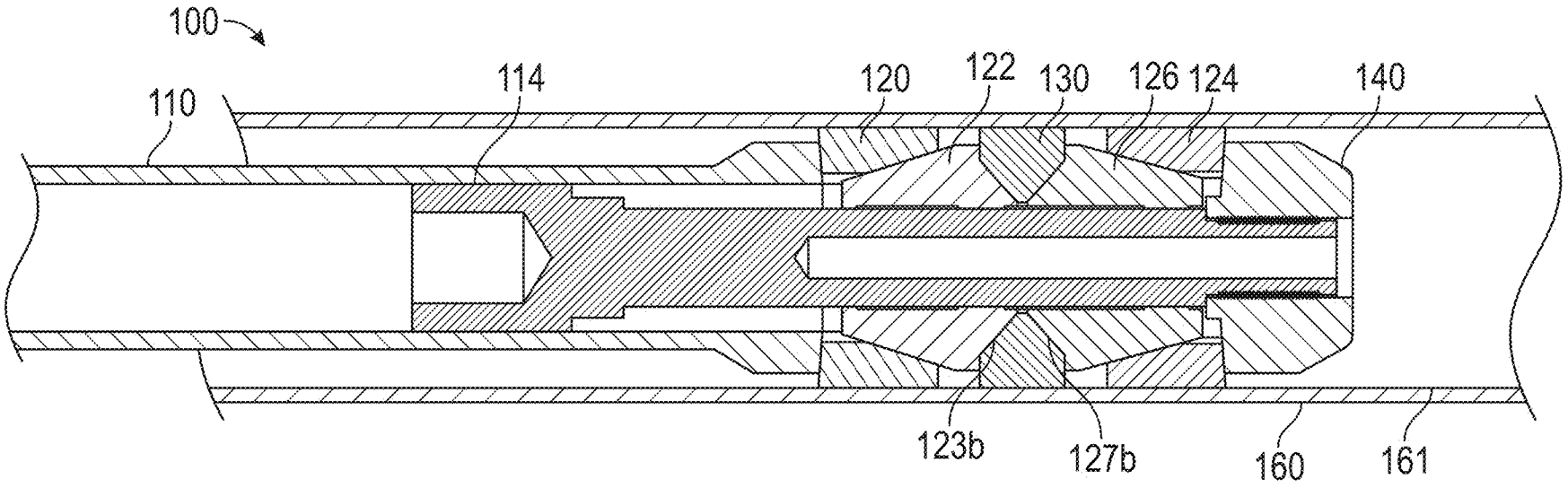
FIG. 2 illustrates a cross-sectional view of the isolation device of FIG. 1 in a set position, in accordance with some embodiments of the present disclosure.

After the isolation device 100 is run in the wellbore to a desired location, it can be set. FIG. 2 shows the isolation device 100 after setting. The isolation device 100 can be mechanically set using wireline or hydraulic setting tools, for example. Unlike conventional isolation device plugs that are set using a spacer ring, the isolation device 100 according to any of the embodiments can also include a setting sleeve 110. The setting sleeve 110 can be attached to a setting tool (not shown). The inner mandrel 114 can also be attached to the setting tool, such that after setting, the inner mandrel 114 and the setting sleeve 110 can be removed from the wellbore-leaving only the slip system and the packer element within the wellbore.

Setting the isolation device 100 can involve applying compression to a slip system to move the slips 120/124 axially towards and along the face of the slip props 122/126 and radially away from the inner mandrel 114 and into engagement with the I.D. 161 of the tubing string or casing 160 and to allow the top slips 120 to maintain engagement with the tubing string or casing 160. The setting sleeve 110 can be mechanically actuated. The force applied to the device can increase the load on the slips 120/124 causing them to break via the slots or grooves (shown in FIG. 1) and ramp up the angled surfaces 123*a*/127*a* of the slip props 122/126 towards each other. Compression that is applied to the slip system causes the top slips 120 to move along the top slip prop 122, which in turn causes a lower end of the mule shoe 140 to move towards the top slips 120. Movement of the mule shoe 140 causes the bottom slips 126 to move along the bottom slip prop 126. The slip props 122/126 can support the slips 120/124 in an expanded position outward from the inner mandrel 114 such that the slips 120/124 engage the I.D. 161 of the tubing string or casing 160 when the isolation device 100 is set. The slip props 122/126 can prevent the slips 120/124 from retracting and releasing from the I.D. 161 of the tubing string once the isolation device 100 is set. When the slips 120/124 are engaged with the tubing string or casing 160, the isolation device 100 has substantially limited or no vertical movement within the wellbore.

Setting the isolation device 100 can further involve causing the packer element 130 to expand radially away from the inner mandrel 114 to form a pressure tight annular seal. The packer element 130 can radially expand outwardly away from the inner mandrel 114 to engage with an inner diameter 161 of the tubing string or casing 160 when the isolation device 100 is set. Downward movement of the setting sleeve 110 and the upward movement of the mule shoe 140 causes the slip props 122/126 to move towards each other and axially compresses the packer element 130 to cause it to expand into engagement with the I.D. 161 of the tubing string or casing 160. Engagement of the packer element 130 with the inside of the tubing string or casing 160 can preferably restrict fluid flow past the packer element.

With continued reference to FIG. 1, the packer element 130 has a width 131 between the top slip prop 122 and the bottom slip prop 126 adjacent to the inner mandrel 114. During setting of the isolation device 100, movement of the slip props 122/126 towards each other decreases the width 131 after setting as shown, for example, in FIG. 2.

According to any of the embodiments, the packer element 130 does not engage the inner mandrel 114 after the isolation device 100 is set. Still with reference to FIGS. 2 and 3, the top slip prop 122 can include a second angled surface 123*b* and the bottom slip prop 126 can include a second angled surface 127*b*. The angle denoted in the drawings as θ (theta) of the angled surfaces 123*b*/127*b* can be selected such that after setting, the packer element 130 is inhibited or prevented from engaging with the inner mandrel 114. By way of example, the angle θ can be in the range of 100° to 170°. In this manner, expansion of the packer element 130 is in a direction away from the inner mandrel 114, and the packer element 130 is substantially prevented from being in direct engagement with the inner mandrel 114. Traditional plugs generally have an angle θ that is greater than 180°—that is, the slip prop's angle in an opposite direction as shown in the Figures. An angle θ greater than 180° allows the packer element to expand towards the inner mandrel and engage with the inner mandrel after setting.

Figure 3:
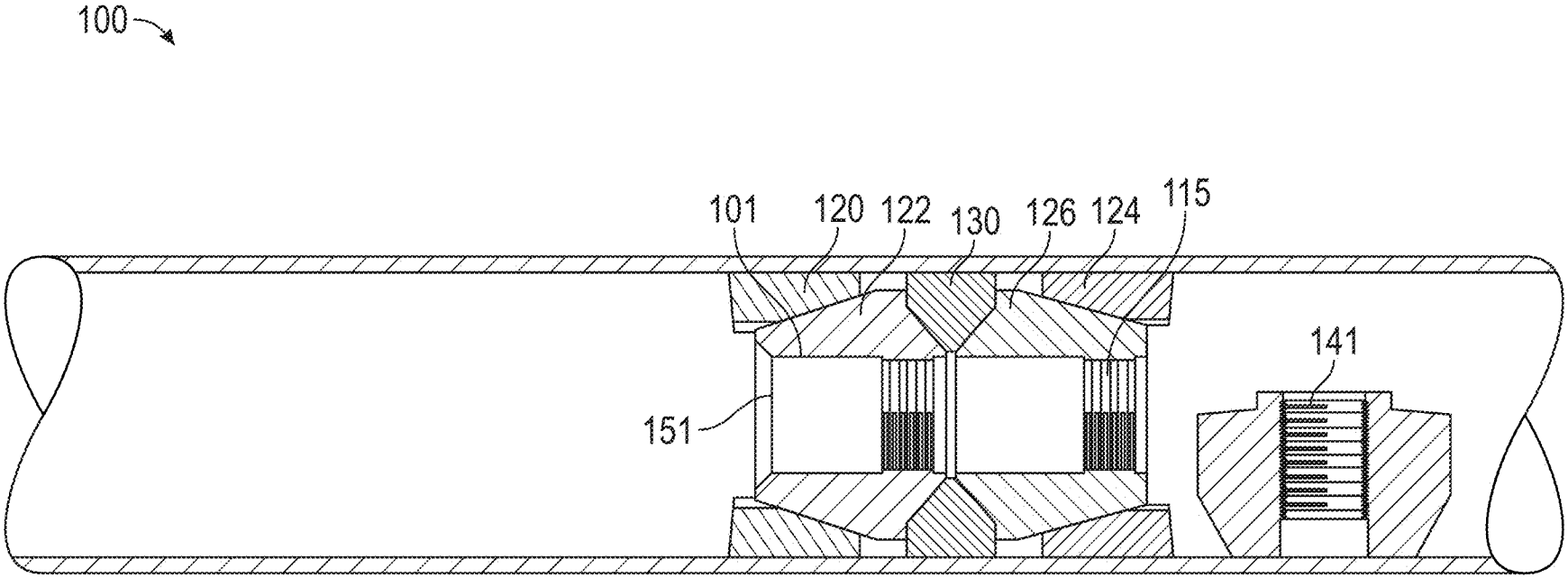
FIG. 3 illustrates a cross-sectional view of an isolation device showing a mule shoe being sheared from the device after setting, in accordance with some embodiments of the present disclosure.
Figure 4:
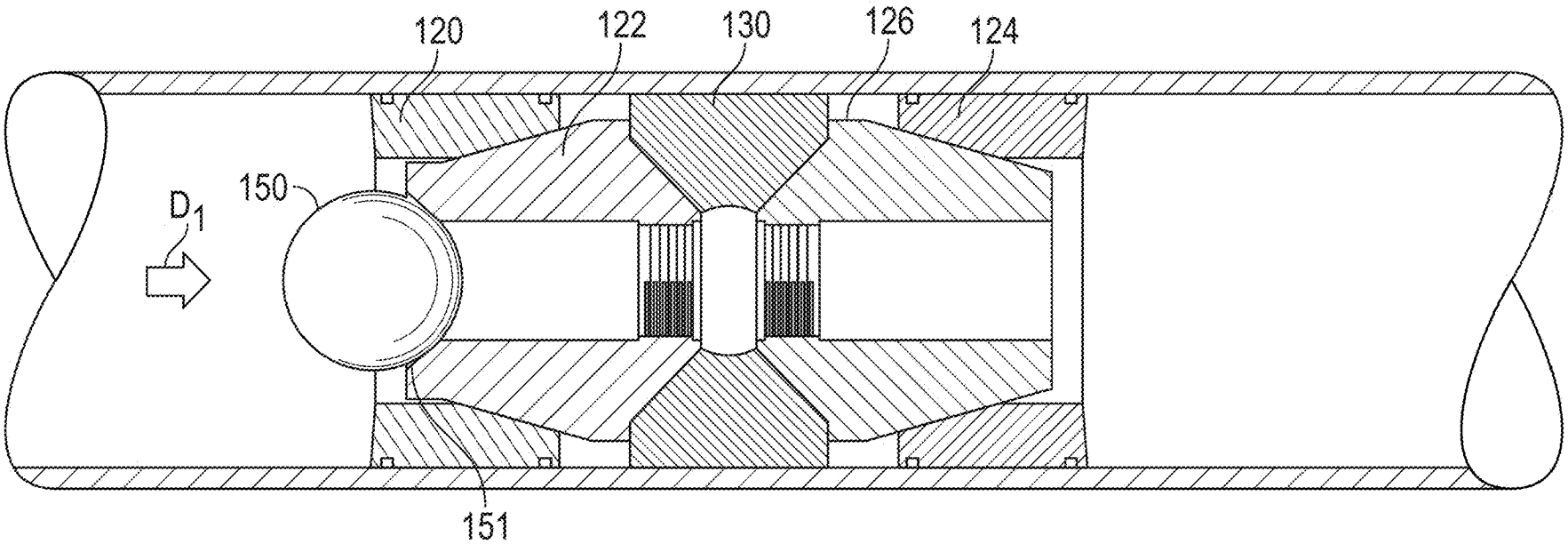
FIG. 4 illustrates a cross-sectional view of the isolation device of FIG. 1 showing a frac ball seated at the top of the isolation device, in accordance with some embodiments of the present disclosure.

As shown in FIG. 3, the mule shoe 140 (e.g., referring to FIG. 2) can include threads 141 for connecting the mule shoe 140 to the inner mandrel 114 via threads 115 on the inner mandrel 114. As also shown, the slip props 122/126 can include threads to connect to the inner mandrel 114 during the run-in position. The threads on the slip props 122/126 can be located on the slip props as shown in one embodiment in FIG. 3 and in a second embodiment in FIG. 4—although the threads can be located in a different area from shown in the Figures. The slip props 122/126 do not have to include threads for connecting to the inner mandrel 114. Continued force applied to the slip system can cause the slip props 122/126 to shear from the inner mandrel 114 when threads are included. The shear force required to shear the slip props 122/126 from the inner mandrel 114 can be less than the force required to shear the mule shoe 140 from the inner mandrel 114. Continued force applied to the slip system also causes movement of the slips 120/124, the slip props 122/126, and the packer element 130. When the slips 120/124, the slip props 122/126, and the packer element 130 have moved into the fully set position, for example as shown in FIGS. 3 and 4, the force being applied no longer causes movement of the components. The system then reaches a predetermined force that shears the mule shoe 140 from engagement with the inner mandrel 114, for example as shown in FIG. 3. After the isolation device 100 has been set and the mule shoe 140 has been sheared, the setting sleeve 110 and the inner mandrel 114 can be removed from the wellbore. The step of removing can include removing the setting tool (not shown) that is connected to the setting sleeve and inner mandrel. The setting sleeve 110 and inner mandrel 114 can be removed, in part, because the packer element 130 is not in direct engagement with the inner mandrel 114 after setting.

The isolation device 100 can include a fluid flow path defined by an inner diameter 101 of the isolation device 100. The flow path through the inner diameter of the isolation device can allow fluids to flow from or into the subterranean formation via a conduit defined by the tubing string or casing 160. According to any of the embodiments, the isolation device 100 has a substantially (i.e., +/−10%) uniform inner diameter after removal of the inner mandrel. By way of example, the top slip prop 122 and the bottom slip prop 126 can have substantially the same dimensions and form a substantially straight line that forms an inner diameter of the device after removal of the inner mandrel 114. Accordingly, the inner diameter of the device after removal of the inner mandrel is preferably not tapered nor staggered.

However, the isolation device 100 can include a staggered or tapered inner diameter 101. The inner diameter 101 can be smaller at an area downstream of the direction of fluid flow. In this manner a ball 150 (e.g., a frac ball) can be flowed through the tubing string or casing 160 into the isolation device 100 and become seated within the isolation device 100 when the ball 150 encounters the smaller inner diameter.

The slip props 122/126 are self-supporting after removal of the inner mandrel 114. As used herein, the term "self-supporting" means the slip props do not require a reinforcing element, such as a mandrel, in order to maintain structural integrity and a fixed position. Thus, the slip props are able to maintain the slips in engagement with the I.D. of the tubing string without the need for a mandrel or other component to support the slip props from the inside of device. This self-support can be achieved by increasing the thickness (as measured from the I.D. to the O.D.) of the slip props 122/126. Traditional plugs that require an inner mandrel to support the slip props in a set position necessitate use of thinner slip props in order to accommodate the inner mandrel while still providing a fluid flow path through the plug. The device disclosed allows a larger diameter fluid flow path due to removal of the inner mandrel 114 after setting, while still providing thicker slip props 122/126 that are self-supporting.

A ball seat 151 may be provided at the top of the device, sometimes on the top slip prop 122. Here, the ball seat 151 is provided at the top of the top slip prop 122 but this can be changed in some embodiments. Below shows an embodiment where the ball seat 151 is positioned within the top slip prop 122, near the center of the top slip prop 122. The fluid flow path through the device can be closed by placing a ball within the ball seat 151. As seen in FIG. 4, a ball 150 can become seated onto the top slip prop 122 when fluid flow is in the direction D1. According to these embodiments, the ball 150 can have an outer diameter that is greater than the inner diameter 161 of a top end of the top slip prop. According to certain embodiments, the ball does not seat within the isolation device after the inner mandrel is removed. It is to be understood that the relative terms "top" and "bottom" are used for convenience purposes and are not meant to indicate a specific orientation. For example, the ball 150 can seat against the bottom slip prop 126 if fluid flow is in a direction opposite of D1.

When desired, fluid flow can be restored through the inner diameter of the isolation device 100. By way of example, if the ball 150 is seated by flowing the ball in the direction D1, then fluid flow can be restored by flowing a fluid in the opposite direction, which will unseat the ball 150. One of the many advantages to the novel isolation device 100 is that fluid flow through the device is increased compared to conventional plugs because the inner diameter of the plug is greater without the inner mandrel 114 being present after setting.

All or a portion of the isolation device 100 can be removed from the tubing string when desirable. Removal can be accomplished by drilling, milling, or dissolving the components of isolation device 100. Another advantage to the novel device is the time for removal is decreased because there are fewer components (e.g., the setting sleeve and inner mandrel) to remove compared to conventional plugs.

Methods of providing zonal isolation can include some or all of the following: introducing the isolation device 100 into a tubing string or casing 160; setting the isolation device 100 at a desired location within the tubing string or casing 160; shearing the mule shoe 140; removing the setting sleeve 110 and the inner mandrel 114; seating a ball 150 against the isolation device 100; performing a treatment operation within the isolated zone; unseating the ball 150; and removing all or a portion of the isolation device 100.

The methods can further include fracturing a portion of a subterranean formation that is penetrated by the wellbore. The step of fracturing can include introducing a fracturing fluid into a zone of the formation, wherein the fracturing fluid creates or enhances a fracture in the formation.

An embodiment of the present disclosure is a zonal isolation device comprising: a top slip; a top slip prop in engagement with the top slip; a bottom slip; a bottom slip prop in engagement with the bottom slip; a packer element positioned between the top slip prop and bottom slip prop, wherein movement of the top slip prop and the bottom slip prop towards each other causes the packer element to expand into engagement with an inner diameter of a tubing string; an inner mandrel, wherein the inner mandrel is removable from the zonal isolation device after engagement of the packer element with the inner diameter of the tubing string; and a ball, wherein the ball is seated onto the top slip prop. Optionally, the device further comprises wherein the isolation device is a frac plug, bridge plug, or zonal isolation plug. Optionally, the device further comprises a setting sleeve, wherein the setting sleeve and the inner mandrel are connecting to a setting tool. Optionally, the device further comprises wherein the top slip prop comprises a first angled surface for engaging with the top slip and a second angled surface, and wherein the bottom slip prop comprises a first angled surface for engaging with the bottom slip and a second angled surface. Optionally, the device further comprises wherein the packer element is located between the second angled surface of the top slip prop and the second angled surface of the bottom slip prop. Optionally, the device further comprises wherein the second angled surface of the top slip prop and the bottom slip prop forms an angle, and wherein the angle is in the range of 100° to 170°. Optionally, the device further comprises a mule shoe, and wherein the mule shoe comprises threads for connecting the mule shoe to a bottom end of the inner mandrel via threads on the inner mandrel. Optionally, the device further comprises wherein the top slip prop and the bottom slip prop are self-supporting after removal of the inner mandrel. Optionally, the device further comprises wherein the zonal isolation device has a substantially uniform inner diameter after removal of the inner mandrel.

Another embodiment of the present disclosure is a method of isolating a zone of a subterranean formation comprising: setting an isolation device within a tubing string at a desired location comprising: mechanically actuating a top slip and a bottom slip into engagement with an inner diameter of the tubing string; and causing movement of a top slip prop and a bottom slip prop towards each other, wherein the movement causes a packer element located between the top slip prop and bottom slip prop to become engaged with the inner diameter of the tubing string; removing an inner mandrel of the isolation device after setting the isolation device within the tubing string at the desired location; and causing a ball to seat onto the top slip prop. Optionally, the method further comprises wherein mechanically actuating the top slip and the bottom slip comprises applying compression to a slip system to move the top slip and the bottom slip axially towards and along a first angled surface of the top slip prop and a first angled surface of the bottom slip prop and radially away from the inner mandrel. Optionally, the method further comprises wherein movement of the top slip along the first angled surface of the top slip prop causes a mule shoe that is connected to a bottom end of the inner mandrel to move towards the top slip. Optionally, the method further comprises wherein the top slip prop further comprises a second angled surface, wherein the bottom slip prop further comprises a second angled surface, and wherein the packer element is located between the second angled surface of the top slip prop and the second angled surface of the bottom slip prop. Optionally, the method further comprises wherein the second angled surface of the top slip prop and the bottom slip prop forms an angle, and wherein the angle is in the range of 100° to 170°. Optionally, the method further comprises a mule shoe, and wherein the mule shoe comprises threads for connecting the mule shoe to a bottom end of the inner mandrel via threads on the inner mandrel. Optionally, the method further comprises shearing the mule shoe from engagement with the inner mandrel, wherein after the isolation device has been set within the tubing string at the desired location, continued application of the compression shears the mule shoe. Optionally, the method further comprises wherein the inner mandrel is removed from the tubing string after the mule shoe has sheared. Optionally, the method further comprises wherein the top slip prop and the bottom slip prop are self-supporting after removal of the inner mandrel. Optionally, the method further comprises wherein the isolation device has a substantially uniform inner diameter after removal of the inner mandrel. Optionally, the method further comprises wherein the ball has a larger outer diameter than the inner diameter of a top end of the top slip prop.

Figure 5:
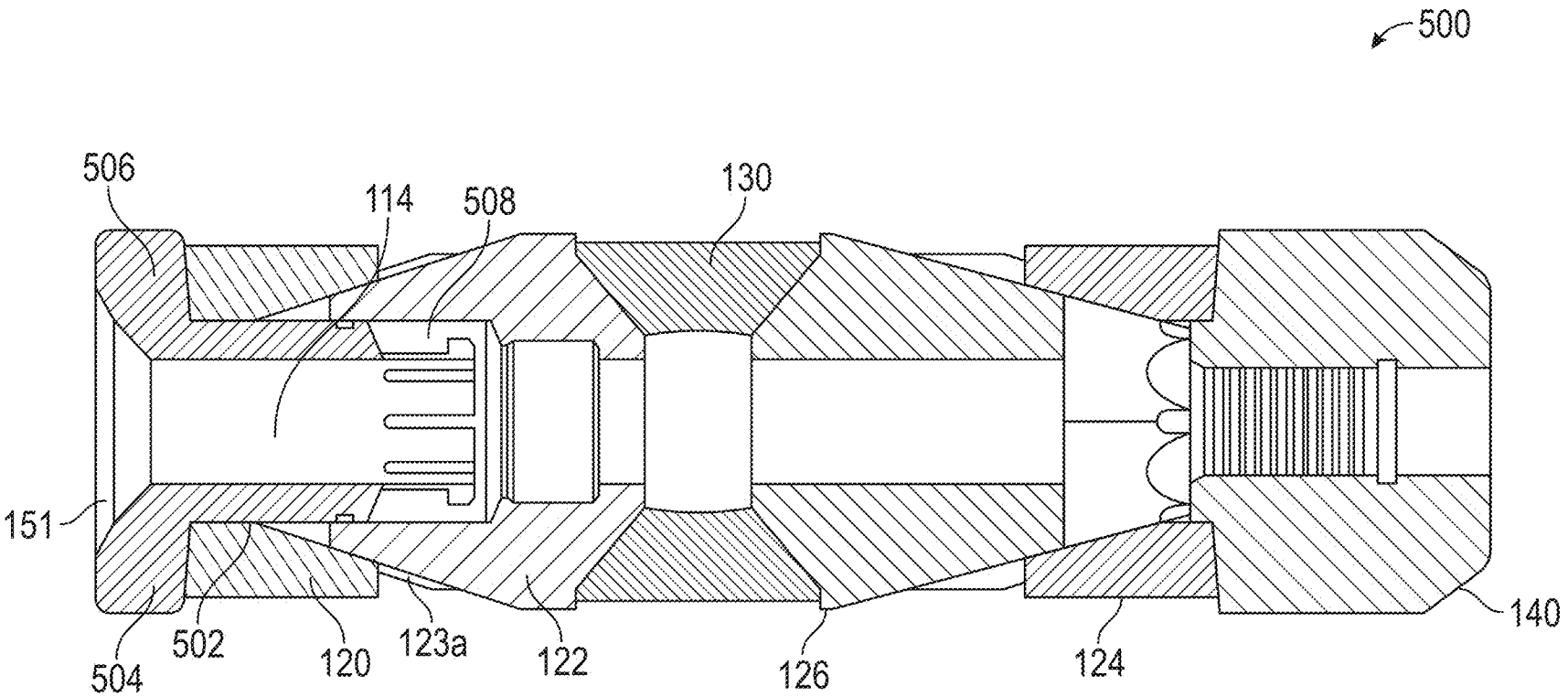
FIG. 5 illustrates a cross-sectional view of an isolation device in a run-in-hole position, and which shows a pressure transfer sleeve, in accordance with some embodiments of the present disclosure.

FIG. 5 illustrates a cross-sectional view of an isolation device 500 in a run-in-hole position, and which shows a pressure transfer sleeve 502 having a flanged end 504, in accordance with some embodiments of the present disclosure. As illustrated, the isolation device 500 may share many, e.g., all, of the same features as the isolation device of the previous figures, including a mule shoe 140, slips 120/124, a bottom slip prop 126, a top slip prop 122, and a packer element 130, to use non-limiting examples. Moreover, isolation device 500 may function in a similar fashion as the isolation device shown in previous figures. As illustrated, isolation device 500 comprises the pressure transfer sleeve 502 which comprises a flanged end 504 and a body 506 that extends longitudinally from the flanged end 504. The body 506 and flanged end 504 may be characterized in some examples as a collar with wings, however other embodiments are possible. Further, a surface of the flanged end 504 may be machined to assist the inner mandrel 114 with receiving a ball (e.g., frac ball) during pump-down, such as by sharing a convex surface contiguous with a portion of the inner mandrel 114 conforming to the dimensions of the ball, which may be referred to as a ball seat 151. In some examples, the inner mandrel 114 and the pressure transfer sleeve 502 may be unitarily formed of a single material or may otherwise comprise a single, or multiple components.

As illustrated, the body 506 of the pressure transfer sleeve 502 may be at least partially disposed within an annular receptacle 508 formed between the inner mandrel 114 and the top slips 120. The annular receptacle 508 may simply comprise a recess, void, or other opening, whereby the body 506 may be inserted during sliding of the inner mandrel 114. The pressure transfer sleeve 502 may be coupled with the inner mandrel 114 in any suitable manner and may contact at least a portion of an outer tubular body thereof. As illustrated, the body 506 of the pressure transfer sleeve 502 may contact at least a portion of the top slips 120 before or during run-in, in some examples. The flanged end 504 also contacts the top slips 120, such that pressure applied to the inner mandrel 114 (e.g., by a frac ball) is transferred, at least in part, to a surface of the top slips 120 during setting of the isolation device 500. This causes the top slips 120 to slide up the angled surface 123*a* of the top slip prop 122 during setting of the isolation device 500, whereby packer element 130 and slips 120/124 are caused to engage the inner diameter of a tubular string, to be shown and described in FIG. 6.

Figure 6:
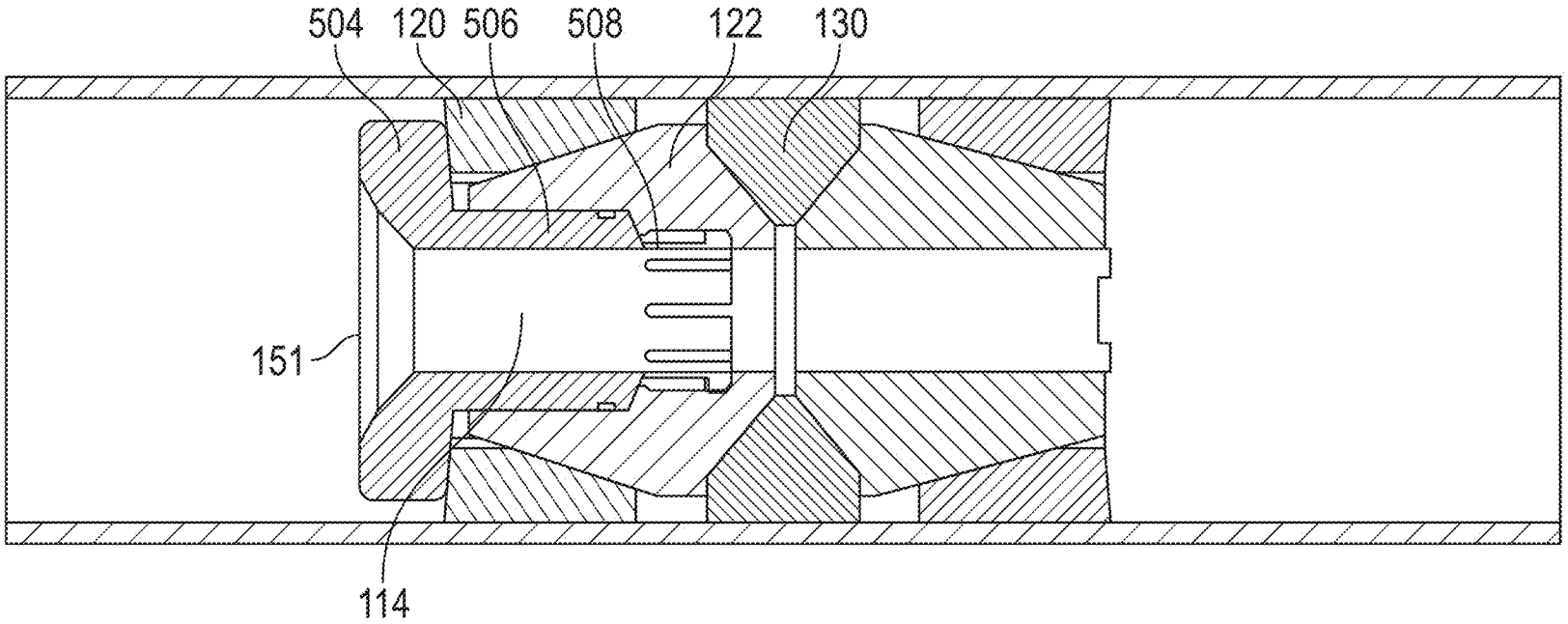
FIG. 6 illustrates a cross-sectional view of the isolation device of FIG. 5 in a set position, in accordance with some embodiments of the present disclosure.

FIG. 6 illustrates a cross-sectional view of the isolation device 500 of FIG. 5 in a set position, in accordance with some embodiments of the present disclosure. As alluded to above, setting of the isolation device 500 in a wellbore may comprise actuating the inner mandrel 114 to cause the body 506 of the pressure transfer sleeve 502 to enter the annular receptacle 508 formed between the mandrel and the top slip prop 122. Movement of the inner mandrel 114 may also cause the flanged end 504 to engage the top slips 120, causing them to slide up the angled surface of the top slip prop 122 and compress the packer element 130 into the set position shown. Thus, the packer element 130 and the slips 120/124 may sealingly engage the inner diameter of a tubing string disposed within the wellbore. It is noted that while the whole annular receptacle 508 is shown as being occupied by the body 506 of the pressure transfer sleeve 502, alternative configurations are possible, for example, where the annular receptacle 508 is only partially occupied by the body 506 when the isolation device 500 is maximally compressed. The amount of compression sustained by an isolation device 500 may vary depending on the amount of load applied and may meet the standards set forth by the American Petroleum Institute in API RP 65-3, 1st Edition, June 2021.

Upon setting of the isolation device 500 at an appropriate depth or location within a wellbore and actuating of the inner mandrel 114, the pressure transfer sleeve 502 of the isolation device 500 and/or inner mandrel 114 may, in some examples, be locked in place using one or more collets, collet fingers, lock rings, or other type of locking device. This may further ensure that the isolation device 500 remains in a set position after setting and prevent the device from becoming dislodged or loose after setting.

In one alternative embodiment, not shown, the inner mandrel 114 may extend completely through the isolation device from top to bottom, which may be locked in place by a larger hub section on one end, and a Mule Shoe or other type of part attached at the other end. In such examples, variable pressure locks into a top wedge and thus may remove the necessity of a Mule Shoe or other component connected to the bottom of an isolation device to remain engaged. Moreover, while not shown, it should be understood that the isolation device 500 of FIGS. 5 and 6 may include one or more of the features described herein, for example, a mule shoe 140 and/or the slip props 122/126 which may be sheared from the inner mandrel 114.

One advantage of the present disclosure made possible by the pressure transfer sleeve 506 is that pressure applied to the inner mandrel 114, body 506, and/or the flanged end 504 may be redirected to the top slips 120, top slip prop 122, and packer element 130. This ensures greater reliability of the isolation device 500 and reduces the likelihood that the isolation device 500 will dislodge at an inopportune time. This may ultimately ensure that a frac plug does not become unset after a hydraulic fracturing operations so that the plug can be tagged during drill-out.

Figure 7:
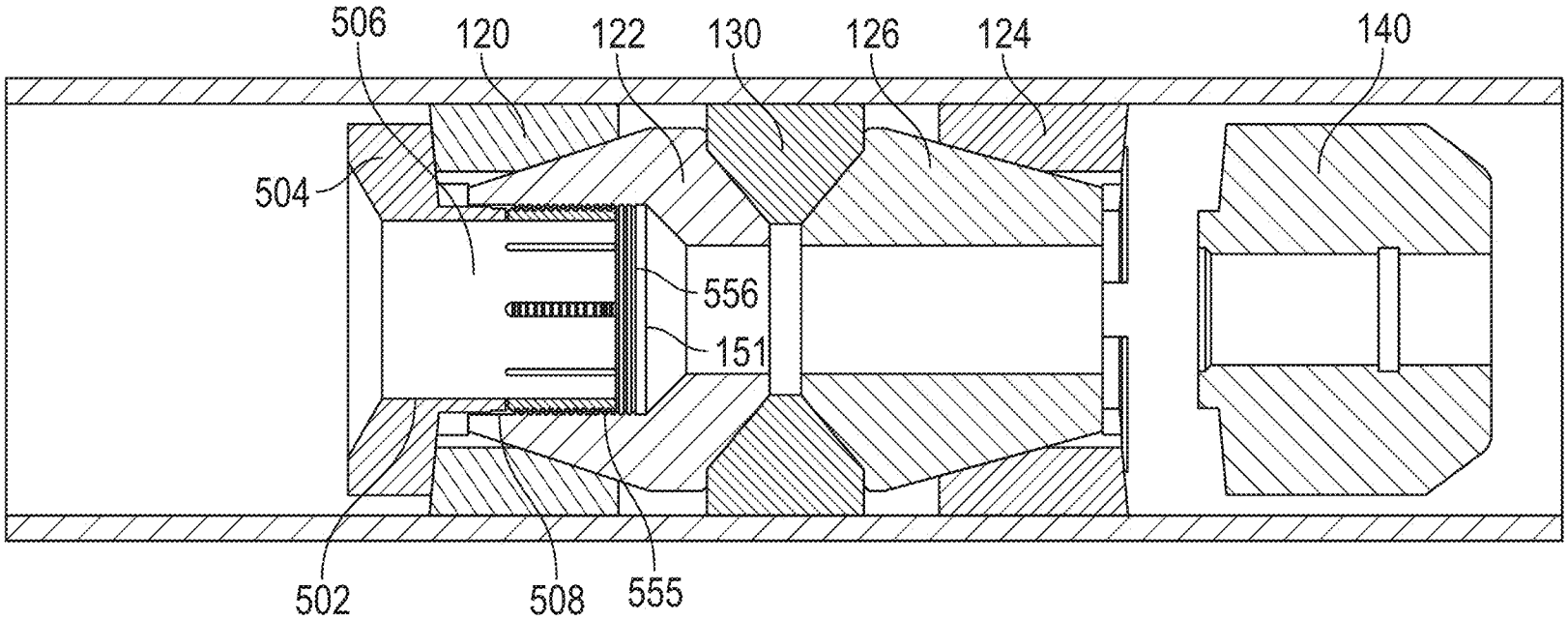
FIG. 7 illustrates a cross-sectional view of another embodiment of an isolation device in a set position with the mule shoe sheared off, and which shows a pressure transfer sleeve as well as a ratchet retention system, in accordance with some embodiments of the present disclosure.

FIG. 7 illustrates a cross-sectional view of another embodiment of an isolation device in a set position with the mule shoe 140 sheared off, and which shows a pressure transfer sleeve 502 as well as a ratchet retention system, in accordance with some embodiments of the present disclosure. In this embodiment, a first ratchet portion 555 may be positioned on the outer surface of the body 506 of the pressure transfer sleeve 502. Further, a second ratchet portion 556 may be positioned on the inner surface of the top slip prop 122 and may be sized to accept and engage with the first ratchet portion 555 in order to hold the top slip prop 122 and pressure transfer sleeve 502 in a fixed position without allowing the pressure transfer sleeve 502 to retract or be removed from the top slip prop 122 once inserted. Stated another way, the engagement between first ratchet portion 555 with second ratchet portion 556 effectively locks the pressure transfer sleeve 502 with the top slip prop 122 and keeps the top slip prop 122 engaged with the top slip 120, preferably at all times once the engagement is made.

Figure 8:
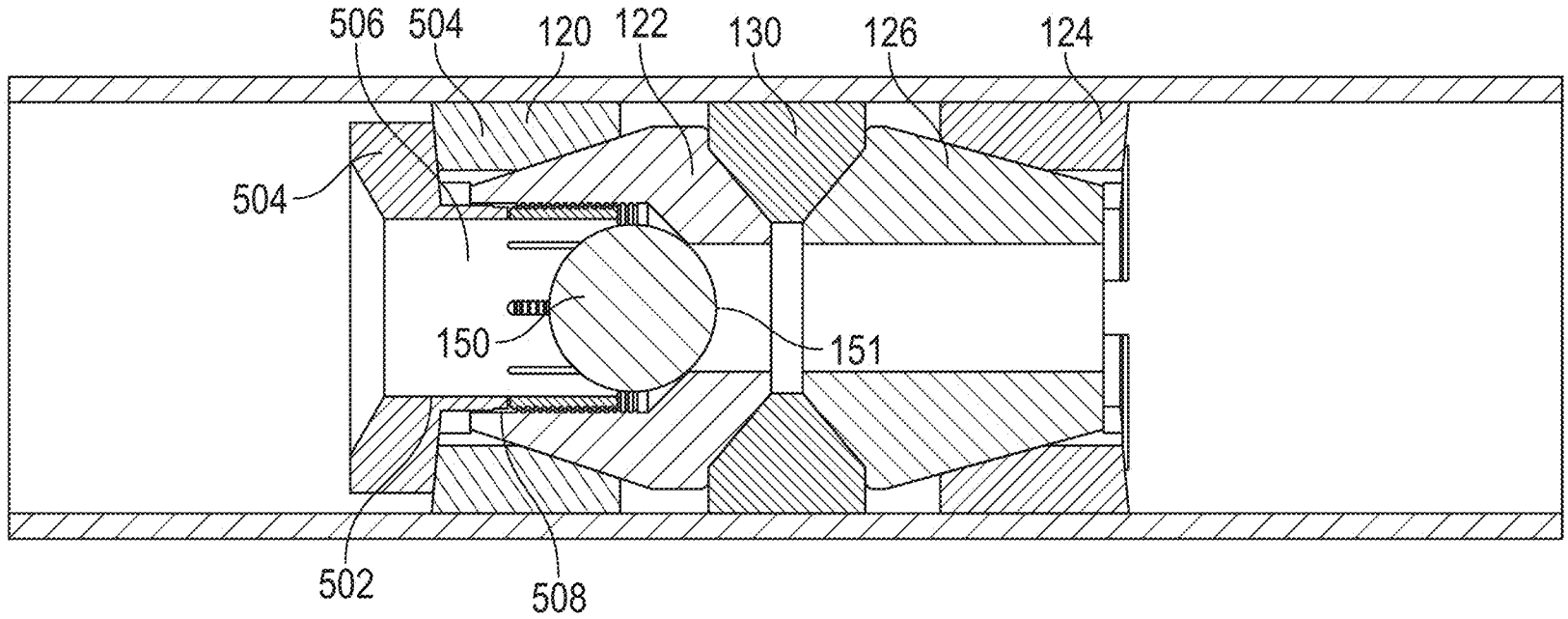
FIG. 8 illustrates a cross-sectional view of the isolation device of FIG. 7 showing a frac ball seated within the isolation device, in accordance with some embodiments of the present disclosure.

FIG. 8 illustrates a cross-sectional view of the isolation device of FIG. 7 showing a frac ball 150 seated within the isolation device on the top of the top slip prop 122 placed so as to cover the opening at the top of the top slip prop 122 to prevent fluid flow through the center bore of the isolation device. A ball seat 151 may be provided at the top of the top slip prop 122 to provide a shape that is similar to that of the frac ball 150 and shaped to accept the frac ball 150 and therefore providing a fluid seal at the location of the ball seat 151. Note that in this embodiment the frac ball 150 sits within the isolation device, preferably inside the top slip prop 122, rather than atop and mostly outside of the isolation device as in some other embodiments. It has been discovered that by using the ratchet portions 555/556, the sidewall of the body 506 can be thinner, allowing a larger bore through the center of the top slip prop 122, which allows the frac ball 150 to rest further downhole in a more secure location to prevent movement of the frac ball 150 and keep the fluid seal created by the frac ball 150 in place.

Figure 9:
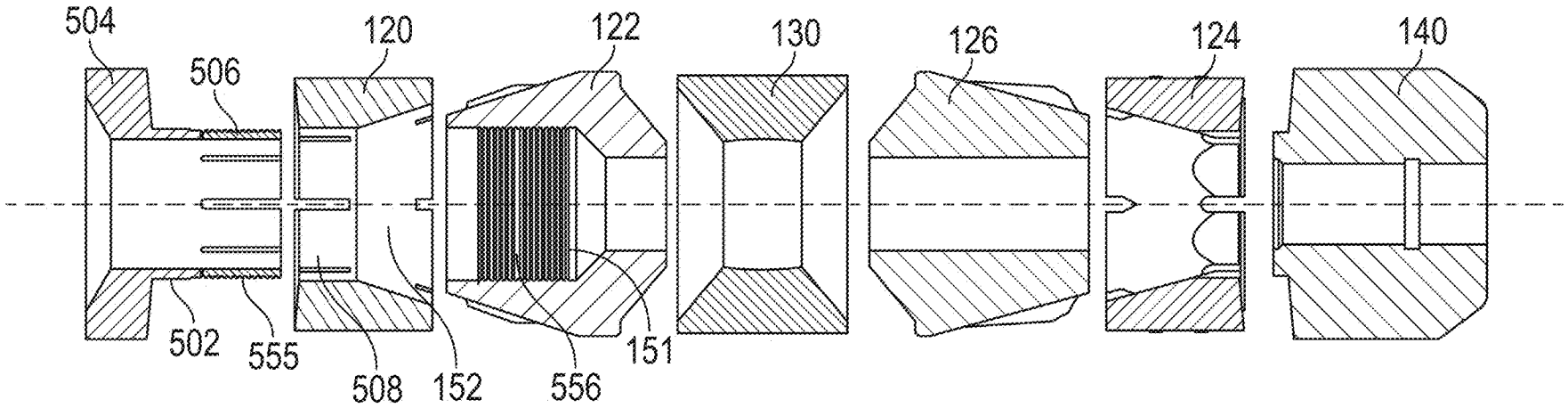
FIG. 9 illustrates an exploded cross-sectional view of the isolation device of FIG. 7, in accordance with some embodiments of the present disclosure.

FIG. 9 illustrates an exploded cross-sectional view of the isolation device of FIG. 7, in accordance with some embodiments of the present disclosure. Here the overall shape and geometry of each component can be observed. For example, the pressure transfer sleeve 502 may have a general 'T' shape where the top of the 'T' provides the flanged end 504 and the vertical portion of the 'T' shape is provided by the body 506 which extends downwardly from the flanged end 504. The first ratchet portion 555 may extend outwardly from the exterior surface of the lower portion of the body 506 and may comprise a series of alternating ridges and valleys. The second ratchet portion 556 may extend inwardly from an interior surface (the central bore in some embodiments) of the top slip prop 122. The second ratchet portion 556 may also comprise a series of alternating ridges and valleys which are sized similar to the first ratchet portion 555 such that the ridge of one ratchet portion will fit within the valley of the opposite ratchet portion. The ridges of the first ratchet portion 555 may extend radially outwardly from the pressure transfer sleeve 502 while the ridges of the second ratchet portion 556 may extend radially inwardly from the top slip prop 122. As the body 506 travels downwardly, more of the ridges/valley will be engaged with one another, resulting in larger and larger forces required to pull the body 506 up-hole, such that the ratchet engagement force becomes substantially stronger than the forces trying to push the body 506 back up-hole and out of the isolation device.

The frac ball seat 151 may be placed near the center of the top slip prop 122 and should be sized to accept the frac ball 150 in order to create a fluid seal at the frac ball seat 151. The second ratchet portion 556 may be placed above the ball seat 151 and preferably would be directly above the ball seat 151. The annular receptacle 508 may be positioned on the up-hole side of the top slip 120 with an opening 152 positioned on the down-hole side of the top slip 120, where the opening 152 is preferably sized to accept a portion of the top slip prop 122.

Accordingly, the present disclosure may provide an isolation device having a reduced risk of becoming dislodged or unset during a hydraulic fracturing operation, a frac ball pump-down, or following a hydraulic fracturing operation.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An isolation device comprising:

a top slip;

a top slip prop in engagement with the top slip;

a bottom slip;

a bottom slip prop in engagement with the bottom slip;

a packer element positioned between the top slip prop and the bottom slip prop, wherein movement of the top slip prop and the bottom slip prop towards each other causes the packer element to expand outwardly;

an annular receptacle formed between an inner mandrel and the top slip prop;

a pressure transfer sleeve at least partially disposed within the annular receptacle, a first ratchet portion positioned on an outer surface of the pressure transfer sleeve; and a second ratchet portion positioned on an inner surface of the top slip prop which is sized to accept and en age with the first ratchet portion.

2. The isolation device of claim 1 further comprising:

a flanged end on the pressure transfer sleeve that extends radially outwards.

3. The isolation device of claim 2 further comprising:

a ball seat formed in the flanged end of the pressure transfer sleeve; and a ball sized to be seatable on the ball seat.

4. The isolation device of claim 2 wherein:

the flanged end of the pressure transfer sleeve engages the top slip.

5. The isolation device of claim 1 wherein:

the packer expands until engagement with an inner diameter of a tubing string.

6. The isolation device of claim 1 further comprising:

a ball seat positioned on the top slip prop.

7. An isolation device comprising:

a top slip;

a top slip prop in engagement with the top slip;

a bottom slip;

a bottom slip prop in engagement with the bottom slip;

a packer element positioned between the top slip prop and the bottom slip prop, wherein movement of the top slip prop and the bottom slip prop towards each other causes the packer element to expand outwardly; and a pressure transfer sleeve at least partially disposed within the top slip prop;

a first ratchet portion positioned on an outer surface of the pressure transfer sleeve; and a second ratchet portion positioned on an inner surface of the top slip prop which is sized to accept and engage with the first ratchet portion.

8. The isolation device of claim 7 wherein:

the first ratchet portion comprises a series of ridges that extend outwardly and radially from the pressure transfer sleeve; and the second ratchet portion comprises a series of ridges that extend inwardly and radially from the top slip prop.

9. The isolation device of claim 7 wherein:

the first and second ratchet portions engage to keep the pressure transfer sleeve from moving once disposed within the top slip prop.

10. The isolation device of claim 7 wherein:

the first and second ratchet portions engage to keep the pressure transfer sleeve in contact with the top slip.

11. The isolation device of claim 7 further comprising:

a ball seat formed in the top slip prop; and a ball sized to be seatable on the ball seat.

12. The isolation device of claim 7 further comprising:

a flanged end on the pressure transfer sleeve that extends radially outwards.

13. The isolation device of claim 12 further comprising:

a ball seat formed in the flanged end of the pressure transfer sleeve; and a ball sized to be seatable on the ball seat.

14. A method for setting an isolation device within a tubing string:

running the isolation device of claim 1 downhole to the desired position;

inserting the pressure transfer sleeve into the isolation device, said pressure transfer sleeve having a body with a flanged end at one end of the body and a ball seat positioned on the flanged end;

expanding the packer until the packer engages with an inner diameter of a tubing string; and placing a ball within the ball seat.

15. The method of claim 14 wherein:

the step of inserting the pressure transfer sleeve is performed by inserting the body of the pressure transfer sleeve into an annular receptable.

16. The method of claim 15 wherein:

the step of inserting the pressure transfer sleeve is performed by inserting the body of the pressure transfer sleeve into the top slip prop.

17. The method of claim 14 further comprising:

engaging the first ratchet portion on the body of the pressure transfer sleeve with the second ratchet portion on the top slip prop.

18. The method of claim 14 further comprising:

holding the pressure transfer sleeve within the isolation device by engaging the first ratchet portion with the second ratchet portion.

* * * * *